US012397976B2

(12) United States Patent
Owen et al.

(10) Patent No.: US 12,397,976 B2
(45) Date of Patent: Aug. 26, 2025

(54) FLIP-TOP CLOSURE AND A PACKAGE

(71) Applicant: Closure Systems International Inc., Indianapolis, IN (US)

(72) Inventors: Robert H. Owen, Crawfordsville, IN (US); Jeremy E. Morin, Zionsville, IN (US)

(73) Assignee: Closure Systems International Inc., Indianapolis, IN (US)

( * ) Notice: Subject to any disclaimer, the term of this patent is extended or adjusted under 35 U.S.C. 154(b) by 58 days.

(21) Appl. No.: 18/619,492

(22) Filed: Mar. 28, 2024

(65) Prior Publication Data

US 2024/0327082 A1 Oct. 3, 2024

Related U.S. Application Data

(60) Provisional application No. 63/492,698, filed on Mar. 28, 2023.

(51) Int. Cl.
*B65D 51/18* (2006.01)
*B65D 43/02* (2006.01)
(Continued)

(52) U.S. Cl.
CPC ..... *B65D 51/18* (2013.01); *B65D 43/0229* (2013.01); *B65D 43/169* (2013.01);
(Continued)

(58) Field of Classification Search
CPC .. B65D 51/18; B65D 43/0229; B65D 43/169; B65D 53/02; B65D 55/06;
(Continued)

(56) References Cited

U.S. PATENT DOCUMENTS 782,579 A 2/1905 Pelton
782,908 A 2/1905 Thomas
(Continued)

FOREIGN PATENT DOCUMENTS

CH 674831 A5 7/1990
CH 675410 A5 9/1990
(Continued)

OTHER PUBLICATIONS

English translation of WO 2021081612 (Year: 2021).*
(Continued)

*Primary Examiner* — Don M Anderson
*Assistant Examiner* — Eric C Baldrighi
(74) *Attorney, Agent, or Firm* — NIXON PEABODY LLP

(57) ABSTRACT

A flip-top closure includes first and second closure portions. The first closure portion includes a top wall portion with a tamper-evident winged section and a middle section, which are connected via a frangible connection. The winged section forms an undercut. The top wall portion includes a drivable structure to assist in threading the flip-top closure into a container. The second closure portion includes an annular skirt portion and a ledge. The annular skirt portion forms an external thread formation. The ledge includes at least one locking protrusion. A hinge connects the first and second closure portions. In an initially closed position, the undercut of the winged section corresponds with and lockingly engages with the locking protrusion. During movement of the hinge from the initially closed position to an open position, the frangible connection breaks leaving the winged section being lockingly engaged with the locking protrusion.

11 Claims, 13 Drawing Sheets

(51) Int. Cl.
*B65D 43/16* (2006.01)
*B65D 53/02* (2006.01)
*B65D 55/06* (2006.01)

(52) U.S. Cl.
CPC ..... *B65D 53/02* (2013.01); *B65D 55/06* (2013.01); *B65D 2251/0021* (2013.01); *B65D 2251/0081* (2013.01); *B65D 2401/15* (2020.05); *B65D 2543/00092* (2013.01); *B65D 2543/00509* (2013.01); *B65D 2543/00972* (2013.01)

(58) Field of Classification Search
CPC .... B65D 2251/0021; B65D 2251/0081; B65D 2401/15; B65D 2543/00092; B65D 2543/00509; B65D 2543/00972; B65D 47/0804; B65D 47/0809; B65D 55/024; B65D 39/08; B65D 43/0254
USPC ..... 220/826, 254.3
See application file for complete search history.

(56) References Cited

U.S. PATENT DOCUMENTS

D113,332 S 2/1939 Michael
3,160,327 A 12/1964 Porcelli
3,282,477 A 11/1966 John
D248,217 S 6/1978 Allen
RE29,850 E 11/1978 Labarre
4,171,749 A 10/1979 Dietmar
4,401,227 A 8/1983 Pehr
4,533,062 A 8/1985 Guenter
4,682,702 A 7/1987 Gach
4,738,376 A * 4/1988 Markus ..... B65D 47/148 220/834
4,795,044 A 1/1989 Beck
4,941,592 A 7/1990 Kitterman
4,974,735 A 12/1990 Newell
4,986,430 A 1/1991 Dutt
D324,175 S 2/1992 Beck
5,129,530 A 7/1992 Fuchs
5,147,054 A * 9/1992 Pehr ..... B65D 51/20 215/253
5,219,084 A 6/1993 King
5,301,849 A 4/1994 Guglielmini
D349,650 S 8/1994 Lonczak
5,437,383 A 8/1995 Stull
5,596,251 A 1/1997 Miller
5,735,426 A 4/1998 Babcock
5,755,360 A 5/1998 Elliott
5,785,209 A 7/1998 Guglielmini
5,810,207 A 9/1998 Hayashida
5,875,942 A 3/1999 Ohmi
D407,979 S 4/1999 Zemlo
5,909,820 A * 6/1999 Yeh ..... A47J 41/0016 220/711
5,915,574 A 6/1999 Adams
D414,696 S 10/1999 Sayers
5,979,681 A 11/1999 Andrepatrick
6,016,931 A 1/2000 Ohmi
6,039,224 A 3/2000 Dallas, Jr.
6,116,445 A 9/2000 Ikemori
D436,040 S 1/2001 Warner
6,247,605 B1 6/2001 Fujie
6,574,848 B2 6/2003 Fujie
6,631,820 B2 10/2003 Harrold
D489,257 S 5/2004 Braaten
D489,258 S 5/2004 Hollmann
6,776,314 B2 8/2004 Odet
6,793,101 B2 9/2004 Shinozaki
D506,134 S 6/2005 Foster
D519,029 S 4/2006 Hicks
D519,843 S 5/2006 Forte
7,044,317 B2 5/2006 Smith
7,073,680 B2 7/2006 Boback
D530,202 S 10/2006 Herald
D530,603 S 10/2006 Lohrman
D536,974 S 2/2007 Smith
D536,975 S 2/2007 Smith
D537,342 S 2/2007 Smith
D538,162 S 3/2007 Smith
D547,182 S 7/2007 Foster
D547,184 S 7/2007 Kim
7,308,988 B2 12/2007 Yashima
D574,239 S 8/2008 Lin
D578,890 S 10/2008 Swanson
D581,790 S 12/2008 Hyde
D588,915 S 3/2009 Lohrman
D592,057 S 5/2009 Guerin
D605,941 S 12/2009 Leonardis
D606,864 S 12/2009 Robinson
D607,726 S 1/2010 Wisniewski
D608,196 S 1/2010 Beilke
D608,198 S 1/2010 Lohrman
D608,199 S 1/2010 Gross
D609,568 S 2/2010 Mazurkiewicz
D610,454 S 2/2010 Lohrman
D612,729 S 3/2010 Lohrman
7,712,618 B2 5/2010 Barre
D621,707 S 8/2010 Breckan
D625,186 S 10/2010 Rossignol
D626,411 S 11/2010 Lohrman
D640,134 S 6/2011 Rognard
D640,556 S 6/2011 Bragg
D648,626 S 11/2011 Oates
D656,029 S 3/2012 Nagata
D663,202 S 7/2012 Biesecker
8,292,111 B2 10/2012 Newberry
D673,044 S 12/2012 Wisniewski
D679,184 S 4/2013 Fedewa
8,448,798 B2 5/2013 Groubert
8,490,804 B2 7/2013 Benoit-Gonin
D702,551 S 4/2014 Wisniewski
8,708,175 B2 4/2014 Smith
D709,761 S 7/2014 Sanders
8,763,830 B2 7/2014 Sadiq
D720,218 S 12/2014 Hutson
D732,740 S 6/2015 Yoon
D743,790 S 11/2015 Hussain
D754,540 S 4/2016 Wang
D755,048 S 5/2016 Baissero
D758,196 S 6/2016 Blake
D766,085 S 9/2016 Smith
D775,950 S 1/2017 Rognard
D785,402 S 5/2017 Shirley
D789,200 S 6/2017 Deringer
D795,698 S 8/2017 Perdue
9,764,879 B2 9/2017 Koenigseder
D801,172 S 10/2017 Bentkovski
D807,738 S 1/2018 Giraud
9,884,706 B1 2/2018 Skillin
D817,181 S 5/2018 Tran
D823,686 S 7/2018 Beaudouin
D830,120 S 10/2018 Munari
10,266,311 B2 4/2019 Rognard
D847,633 S 5/2019 Berge
D857,502 S 8/2019 Fracasso
D859,143 S 9/2019 Perdue
D859,154 S 9/2019 Skillin
D864,719 S 10/2019 Javier
D871,904 S 1/2020 Berge
D871,905 S 1/2020 Kim
10,654,625 B2 5/2020 Migas
10,822,148 B2 11/2020 Sterling
10,829,274 B2 11/2020 Pristera
D904,188 S 12/2020 McRiner
D904,884 S 12/2020 Wohlgenannt
D914,498 S 3/2021 Palandri
D920,112 S 5/2021 Berge
D920,787 S 6/2021 Partsch, IV
D922,871 S 6/2021 Dietvorst
D930,474 S 9/2021 Faragher
D931,102 S 9/2021 Asprey

(56) References Cited

U.S. PATENT DOCUMENTS

| | | | | |
|---|---|---|---|---|
| D941,148 | S | 1/2022 | Graux | |
| D949,687 | S | 4/2022 | Flaherty | |
| D949,689 | S | 4/2022 | Wiebenga | |
| D957,253 | S | 7/2022 | Johnson | |
| D961,387 | S | 8/2022 | Milan | |
| D962,644 | S | 9/2022 | Ren | |
| D962,767 | S | 9/2022 | Lupberger | |
| D964,167 | S | 9/2022 | Sterling | |
| D981,234 | S | 3/2023 | Konger | |
| D997,638 | S | 9/2023 | Javier | |
| D998,463 | S | 9/2023 | Konger | |
| D998,464 | S | 9/2023 | Konger | |
| D1,003,161 | S | 10/2023 | Chong | |
| 11,801,977 | B1 | 10/2023 | Gray | |
| 2001/0011649 | A1 | 8/2001 | Fujie | |
| 2001/0015355 | A1 | 8/2001 | Adams | |
| 2002/0104843 | A1 | 8/2002 | Smith | |
| 2002/0130100 | A1 | 9/2002 | Smith | |
| 2003/0034323 | A1 | 2/2003 | Smith | |
| 2003/0057209 | A1 | 3/2003 | Seelhofer | |
| 2004/0065665 | A1 | 4/2004 | Mahdi | |
| 2004/0188374 | A1 | 9/2004 | Ochoa Laburu | |
| 2005/0023285 | A1 | 2/2005 | Keung | |
| 2010/0140266 | A1* | 6/2010 | Lohrman | B65D 47/0838 220/254.3 |
| 2010/0264145 | A1 | 10/2010 | Benoit-Gonin | |
| 2011/0000928 | A1 | 1/2011 | Antier | |
| 2011/0011821 | A1 | 1/2011 | Lohrman | |
| 2011/0017736 | A1 | 1/2011 | Guglielmini | |
| 2011/0284590 | A1 | 11/2011 | Brannon | |
| 2012/0067922 | A1 | 3/2012 | Benoit-Gonin | |
| 2012/0080442 | A1* | 4/2012 | Groubert | B65D 53/02 220/849 |
| 2012/0211505 | A1 | 8/2012 | Vollers | |
| 2012/0241480 | A1 | 9/2012 | Hindle | |
| 2013/0026188 | A1 | 1/2013 | Lenz | |
| 2013/0319968 | A1* | 12/2013 | Edie | B65D 41/04 53/490 |
| 2014/0008381 | A1 | 1/2014 | Quinn | |
| 2014/0138380 | A1 | 5/2014 | Fox | |
| 2015/0175318 | A1 | 6/2015 | Pellerin | |
| 2015/0375908 | A1 | 12/2015 | Rognard | |
| 2016/0368674 | A1 | 12/2016 | Ferrari | |
| 2017/0297780 | A1 | 10/2017 | Cesare | |
| 2018/0118423 | A1 | 5/2018 | Bois | |
| 2018/0127179 | A1* | 5/2018 | Port | B65D 47/0885 |
| 2018/0170628 | A1 | 6/2018 | Rognard | |
| 2018/0229903 | A1 | 8/2018 | Lee | |
| 2018/0319551 | A1 | 11/2018 | Ferrari | |
| 2018/0319556 | A1 | 11/2018 | Straughan | |
| 2019/0100361 | A1 | 4/2019 | Stoneberg | |
| 2019/0119008 | A1 | 4/2019 | Berroa Garcia | |
| 2020/0017260 | A1 | 1/2020 | Migas | |
| 2021/0101722 | A1 | 4/2021 | Migas | |
| 2021/0114783 | A1 | 4/2021 | Sibley | |

FOREIGN PATENT DOCUMENTS

| | | | | |
|---|---|---|---|---|
| EP | 926075 | A1 | 6/1999 | |
| FR | 2842177 | A1 | 1/2004 | |
| GB | 2430667 | A | 4/2007 | |
| WO | 1997037900 | A1 | 10/1997 | |
| WO | 1998057864 | A1 | 12/1998 | |
| WO | 2002028735 | A1 | 4/2002 | |
| WO | 2002053472 | A1 | 7/2002 | |
| WO | 2009056829 | A1 | 5/2009 | |
| WO | 2010112801 | A1 | 10/2010 | |
| WO | 2012131097 | A1 | 10/2012 | |
| WO | 2015049066 | A1 | 4/2015 | |
| WO | WO-2021081612 | A1 * | 5/2021 | B65D 43/0235 |

OTHER PUBLICATIONS

"Tac Flip Top Cap 28mm" One Plus Ambalaj, oneplusambalaj.com/product/tac-flip-top-cap-28mm/. Accessed Dec. 7, 2023.

"Flip Top Closures: The Convenient and Sustainable Packaging Solution for Today's Market" Efficient Innovations, May 4, 2023, efficientinnovations.in/flip-top-closures-the-convenient-and-sustainable-packaging-solution-for-todays-market/. Accessed Dec. 5, 2023.

"White 28mm Flip Top Plastic Cover" Roth Sugar Bush, rothsugarbush.com/product/white-28mm-flip-top-plastic-cover/ Accessed Dec. 7, 2023.

"Nestle Coffee Mate Creamer" Amazon, Mar. 7, 2022, amazon.com/coffee-mate-coffee-creamer-liquid-coconut/dp/B0010B8C3A/ref=cm_cr_arp_d_product_top?ie=UTF8. Accessed Feb. 11, 2023.

* cited by examiner

FLIP-TOP CLOSURE AND A PACKAGE

CROSS-REFERENCE TO RELATED APPLICATION

This application claims priority to and benefit of U.S. Provisional Patent Application No. 63/492,698 filed Mar. 28, 2023, which is hereby incorporated by reference herein in its entirety.

FIELD OF THE INVENTION

The present invention relates generally to a polymeric closure for a package. More specifically, the present invention relates to a polymeric closure that is a flip-top closure with tamper-evidency.

BACKGROUND OF THE INVENTION

Polymeric closures have been used in many applications over the years in conjunction with containers. One type of polymeric closure that has been used with containers is a tamper-evident polymeric closure. Tamper-evident closures are used to prevent or inhibit tampering by providing a visible indication to a user if the closure has been opened.

Some tamper-evident features for flip-top closures include the use of a foil or induction liner, or tear-member mechanisms. The lining is located on a top surface of the finish on the container. The use of foil liners tends to be expensive and also requires additional manufacturing steps in forming the package. Additionally, some users, especially those with upper extremity limitations, may have difficulty in manually removing the tamper-evident liners. The removal also may sometimes require using sharp utensils to cut from the finish when the liner is not easily peeled off. The use of liners also does not assist in post-consumer recycling efforts when the liners are not completely removed because the liners are almost always made from different materials than the closures and containers.

It would be desirable to provide a closure and package that overcomes such problems, while still performing desirable properties of a closure and package including providing tamper-evidency.

SUMMARY

According to one aspect of the present disclosure, a tamper-evident, flip-top closure comprises a first closure portion, a second closure portion and a hinge. The first closure portion includes a polymeric top wall portion. The polymeric top wall portion includes an exterior surface and an interior surface. The polymeric top wall portion includes at least one tamper-evident winged section and a middle section. The at least one tamper-evident winged section and the middle section are detachably connected via a frangible connection. The at least one tamper-evident winged section forms an undercut. The exterior surface of the polymeric top wall portion includes a drivable structure to assist in threading the flip-top closure into a container. The second closure portion includes a polymeric annular skirt portion and a ledge. The ledge encompasses and extends outwardly from the polymeric annular skirt portion. The polymeric annular skirt portion includes an exterior surface and an interior surface. The exterior surface of the polymeric annular skirt portion forms an external thread formation. The ledge includes at least one locking protrusion. The interior surface of the polymeric annular skirt portion forms an opening therethrough. The hinge connects the first closure portion and the second closure portion. In an initially closed position of the flip-top closure, the undercut of the at least one tamper-evident winged section corresponds with and lockingly engages with the at least one locking protrusion. During movement of the hinge from the initially closed position to an open position, the frangible connection breaks leaving the at least one tamper-evident winged section being lockingly engaged with the at least one locking protrusion.

According to a configuration of the above implementation, the drivable structure is a recessed structure. The drivable structure may protrude outwardly from a remainder of the interior surface of the polymeric top wall portion.

According to a further configuration of the above implementation, the interior surface of the polymeric top wall portion includes at least one end extension extending therefrom and the second closure portion includes at least one end extension. The end extension of the polymeric top wall portion and the end extension of the second closure portion are configured and located to abut each other and assist in threading of the flip-top closure into the container. In another embodiment, the at least one end extension of the polymeric top wall portion is a plurality of end extensions and the at least one end extension of the second closure portion is a plurality of end extensions. The plurality of end extensions of the polymeric top wall portion and the plurality of end extensions of the second closure portion are configured and located to abut a respective one of each other and assist in threading of the flip-top closure into the container.

In a further aspect of the above implementation, the first closure portion further includes a first sealing ring and the second closure portion further includes a second sealing ring. One of the first and the second sealing rings is slightly larger than the other and forms a seal when the flip-top closure is in a closed position.

In yet a further aspect of the above implementation, the second closure portion further includes a mechanical closure stop that corresponds with a mechanical container stop of a container to prevent or inhibit further threading of the flip-top closure into the container. The mechanical closure stop is located father from the polymeric top wall portion than the external thread formation.

According to a configuration of the above implementation, the flip-top closure is polymeric.

According to another aspect of the present disclosure, a package comprising a container and a flip-top closure. The container has a neck portion defining an opening. The neck portion has an exterior surface and an interior surface. The interior surface of the neck portion includes an internal thread formation. The flip-top closure is configured for fitment into the neck portion of the container for closing the opening of the container. The flip-top closure includes a first closure portion, a second closure portion, and a hinge. The first closure portion includes a polymeric top wall portion. The polymeric top wall portion includes an exterior surface and an interior surface. The polymeric top wall portion includes at least one tamper-evident winged section and a middle section. The at least one tamper-evident winged section and the middle section are detachably connected via a frangible connection. The at least one tamper-evident winged section forms an undercut. The exterior surface of the polymeric top wall portion includes a drivable structure to assist in threading the flip-top closure into the container. The second closure portion includes a polymeric annular skirt portion and a ledge. The ledge encompasses and extends outwardly from the polymeric annular skirt portion. The polymeric annular skirt portion includes an exterior surface and an interior surface. The exterior surface of the polymeric annular skirt portion forms an external thread formation. The external thread formation of the second closure portion is threadingly engaged with the internal thread formation of the container. The ledge includes at least one locking protrusion. The interior surface of the polymeric annular skirt portion forms an opening therethrough. The hinge connects the first closure portion and the second closure portion. In an initially closed position of the flip-top closure, the undercut of the at least one tamper-evident winged section corresponds with and lockingly engages with the at least one locking protrusion. During movement of the hinge from the initially closed position to an open position, the frangible connection breaks leaving the at least one tamper-evident winged section being lockingly engaged with the at least one locking protrusion.

According to a configuration of the above implementation, the drivable structure is a recessed structure. The drivable structure may protrude outwardly from a remainder of the interior surface of the polymeric top wall portion.

According to a further configuration of the above implementation, the interior surface of the polymeric top wall portion includes at least one end extension extending therefrom and the second closure portion includes at least one end extension. The end extension of the polymeric top wall portion and the end extension of the second closure portion are configured and located to abut each other and assist in threading of the flip-top closure into the container. In another embodiment, the at least one end extension of the polymeric top wall portion is a plurality of end extensions and the at least one end extension of the second closure portion is a plurality of end extensions. The plurality of end extensions of the polymeric top wall portion and the plurality of end extensions of the second closure portion are configured and located to abut a respective one of each other and assist in threading of the flip-top closure into the container.

In a further aspect of the above implementation, the first closure portion further includes a first sealing ring and the second closure portion further includes a second sealing ring. One of the first and the second sealing rings is slightly larger than the other and forms a seal when the flip-top closure is in a closed position.

In yet a further aspect of the above implementation, the second closure portion further includes a mechanical closure stop and the container further includes a mechanical container stop. The mechanical closure stop corresponds with the mechanical container stop to assist in preventing or inhibiting further threading of the flip-top closure into the container. The mechanical closure stop is located father from the polymeric top wall portion than the external thread formation.

According to a further aspect of the present disclosure, a tamper-evident, flip-top closure comprises a first closure portion, a second closure portion and a hinge. The first closure portion includes a polymeric top wall portion. The polymeric top wall portion includes an exterior surface and an interior surface. The polymeric top wall portion includes a plurality of opposing tamper-evident winged sections and a middle section therebetween. The plurality of opposing tamper-evident winged sections and the middle section are detachably connected via a respective one of a plurality of frangible connections. Each of the plurality of opposing tamper-evident winged sections forms a respective undercut. The exterior surface of the polymeric top wall portion includes a drivable structure to assist in threading the flip-top closure into a container. The second closure portion includes a polymeric annular skirt portion and a ledge. The ledge encompasses and extends outwardly from the polymeric annular skirt portion The polymeric annular skirt portion includes an exterior surface and an interior surface. The exterior surface of the polymeric annular skirt portion forms an external thread formation. The ledge includes a plurality of opposing locking protrusions. The interior surface of the polymeric annular skirt portion forms an opening therethrough. The hinge connects the first closure portion and the second closure portion. In an initially closed position of the flip-top closure, each of the undercuts of the plurality of opposing tamper-evident winged sections corresponds with and lockingly engages with a respective one of the plurality of opposing locking structures. During movement of the hinge from the initially closed position to an open position, the plurality of frangible connections breaks leaving the plurality of opposing tamper-evident winged sections being lockingly engaged with a respective one of the plurality of opposing locking protrusions.

According to a configuration of the above implementation, the drivable structure is a recessed structure.

According to a further configuration of the above implementation, the interior surface of the first closure portion further includes a plurality of end extensions extending therefrom and wherein the second closure portion further includes a plurality of end extensions. The plurality of end extensions of the first closure portion and the plurality of end extensions of the second closure portion are configured and located to abut a respective one of each other and assist in threading of the flip-top closure into the container.

According to a yet another aspect of the present disclosure, a package comprises a container and a flip-top closure. The container has a neck portion defining an opening. The neck portion has an exterior surface and an interior surface. The interior surface of the neck portion includes an internal thread formation. The flip-top closure is configured for fitment into the neck portion of the container for closing the opening of the container. The flip-top closure includes a first closure portion, a second closure portion, and a hinge. The first closure portion includes a polymeric top wall portion. The polymeric top wall portion includes an exterior surface and an interior surface. The polymeric top wall portion includes a plurality of opposing tamper-evident winged sections and a middle section therebetween. The plurality of opposing tamper-evident winged sections and the middle section are detachably connected via a respective one of a plurality of frangible connections. Each of the plurality of opposing tamper-evident winged sections forms a respective undercut. The exterior surface of the polymeric top wall portion includes a drivable structure to assist in threading the flip-top closure into a container. The second closure portion includes a polymeric annular skirt portion and a ledge. The ledge encompasses and extends outwardly from the polymeric annular skirt portion. The polymeric annular skirt portion includes an exterior surface and an interior surface. The exterior surface of the polymeric annular skirt portion forms an external thread formation. The external thread formation of the second closure portion is threadingly engaged with the internal thread formation of the container. The ledge includes a plurality of opposing locking protrusions. The interior surface of the polymeric annular skirt portion forms an opening therethrough. The hinge connects the first closure portion and the second closure portion. In an initially closed position of the flip-top closure, each of the undercuts of the plurality of opposing tamper-evident winged sections corresponds with and lockingly engages with a respective one of the plurality of opposing locking structures. During movement of the hinge from the initially closed position to an open position, the plurality of frangible connections breaks leaving the plurality of opposing tamper-evident winged sections being lockingly engaged with a respective one of the plurality of opposing locking protrusions.

According to a further aspect of the present disclosure, a tamper-evident, snap-on, flip-top closure comprises a first closure portion, a second closure portion and a hinge. The first closure portion includes a polymeric top wall portion. The polymeric top wall portion includes at least one tamper-evident wing. The at least one tamper-evident wing is detachably connected to a remainder of the polymeric top wall portion via a frangible connection. The at least one tamper-evident wing forms an undercut. The second closure portion includes a polymeric top wall portion and a polymeric annular skirt portion encompassing and extending from the polymeric top wall portion of the second closure portion. The polymeric top wall portion of the second closure portion forms at least one locking recess that includes an undercut. The at least one locking recess is sized and configured to receive the at least one tamper-evident wing thereon. The hinge connects the first closure portion and the second closure portion. In an initially closed position of the snap-on, flip-top closure, the undercut of the at least one tamper-evident wing corresponds with and lockingly engages with the at least one locking recess. During movement of the hinge from the initially closed position to an open position, the frangible connection breaks leaving the at least one tamper-evident wing being lockingly engaged with the at least one locking recess.

According to a further aspect of the present disclosure, a package comprises a container and a flip-top closure. The container has a neck portion defining an opening. The neck portion has an exterior surface and an interior surface. The interior surface of the neck portion includes an internal thread formation. The flip-top closure is configured for fitment into the neck portion of the container for closing the opening of the container. The flip-top closure includes a first closure portion, a second closure portion, and a hinge. The first closure portion includes a polymeric top wall portion. The polymeric top wall portion includes at least one tamper-evident wing. The at least one tamper-evident wing is detachably connected to a remainder of the polymeric top wall portion via a frangible connection. The at least one tamper-evident wing forms an undercut. The second closure portion includes a polymeric top wall portion and a polymeric annular skirt portion encompassing and extending from the polymeric top wall portion of the second closure portion. The polymeric top wall portion of the second closure portion forms at least one locking recess that includes an undercut. The at least one locking recess is sized and configured to receive the at least one tamper-evident wing thereon. The hinge connects the first closure portion and the second closure portion. In an initially closed position of the snap-on, flip-top closure, the undercut of the at least one tamper-evident wing corresponds with and lockingly engages with the at least one locking recess. During movement of the hinge from the initially closed position to an open position, the frangible connection breaks leaving the at least one tamper-evident wing being lockingly engaged with the at least one locking recess.

The above summary is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which.

Figure 1A:
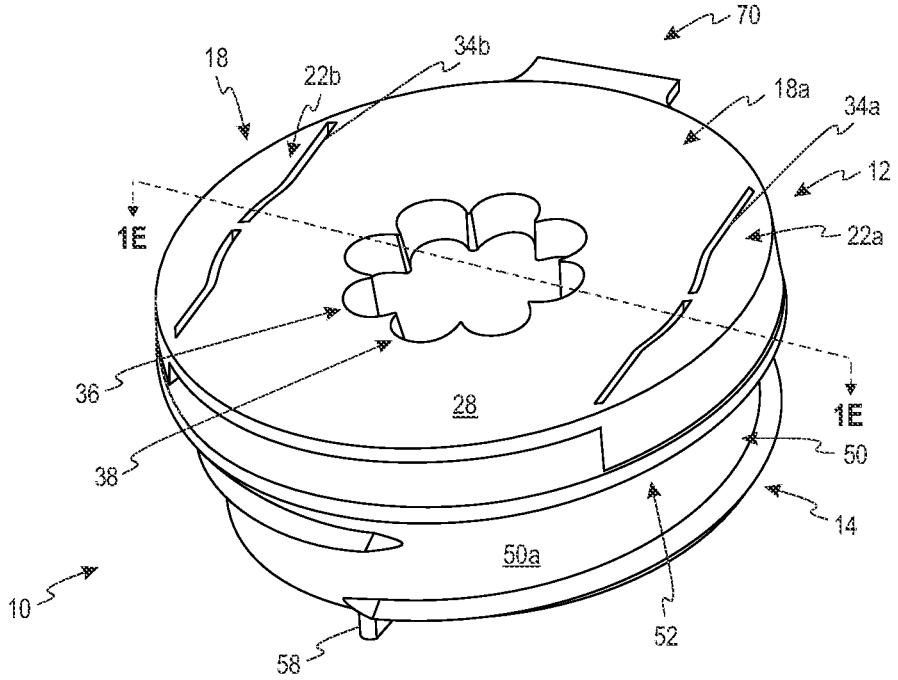
FIG. 1A is a top perspective view of a polymeric flip-top closure in an initially closed position according to one embodiment.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Figure 1B:
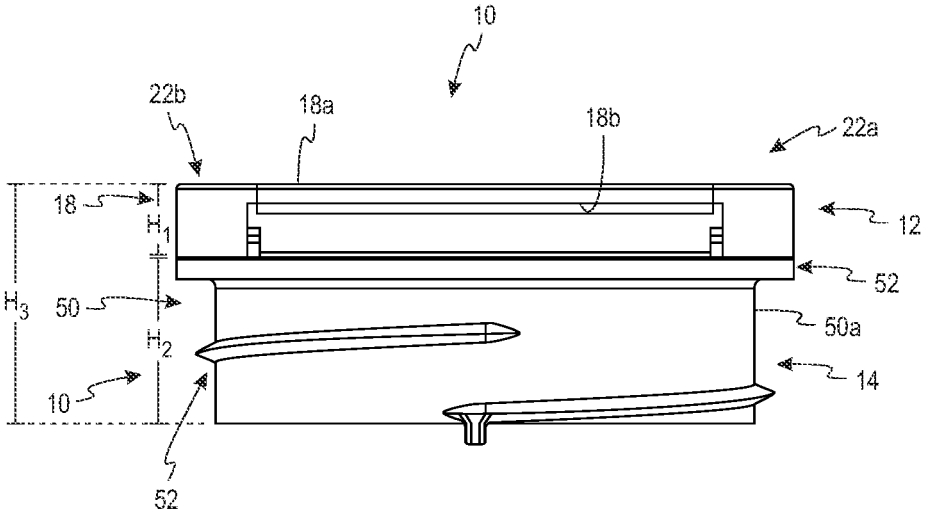
FIG. 1B is a side view of the flip-top closure of FIG. 1A in the closed position.
Figure 1C:
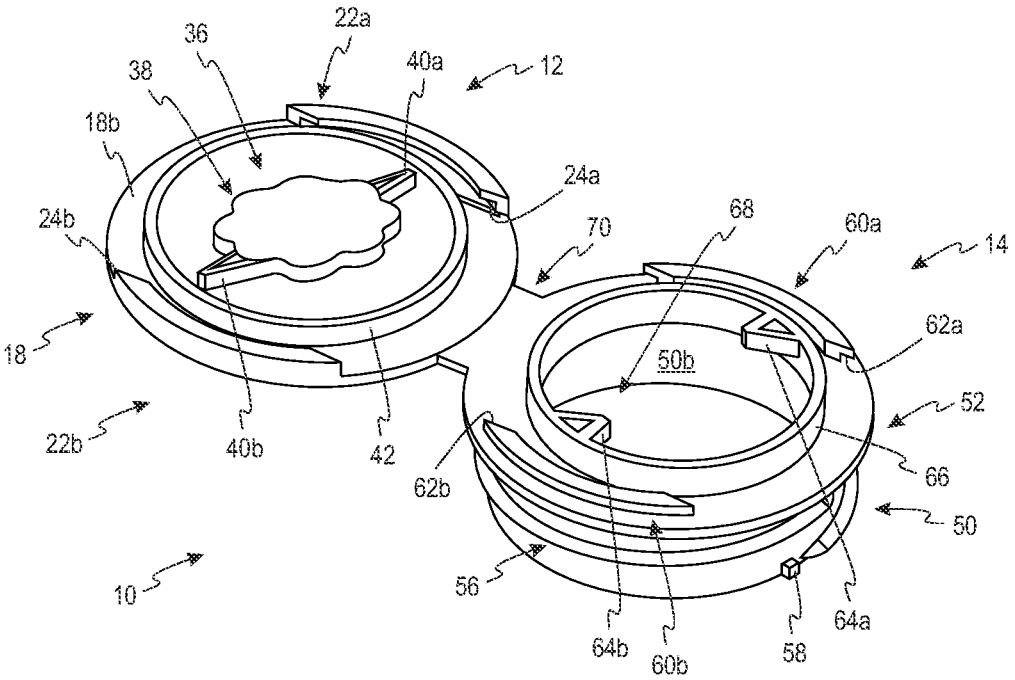
FIG. 1C is a top perspective view of the flip-top closure of FIG. 1A in an initially open position.
Figure 1D:
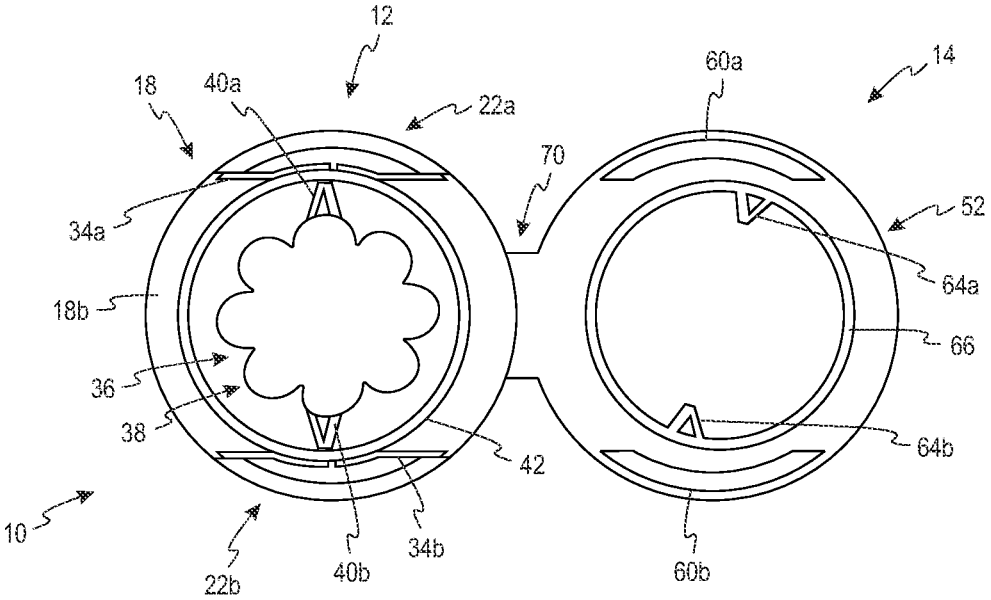
FIG. 1D is a top view of the flip-top closure of FIG. 1A in the open position.

FIGS. 1A-1D illustrate a polymeric flip-top closure 10 according to one embodiment. FIG. 1A, 1B illustrate the polymeric flip-top closure 10 in a closed position in top perspective and side views, respectively. FIGS. 1C, 1D illustrate the polymeric flip-top closure 10 in an open position in top perspective and side views, respectively. The polymeric flip-top closure 10 is generally cylindrically shaped.

The polymeric flip-top closures of the present invention are configured to be placed in a container or bottle that contain product. More specifically, the polymeric flip-top closures of the present invention are configured for fitment into a neck portion or finish of the container for closing the opening of the container. A non-limiting example of a container that may be used with the polymeric flip-top closure 10 is shown with a container 108 in FIG. 2. The polymeric flip-top closure 10 is used with the container 108 to form a package 100 according to one embodiment of the present invention. The package 100 is shown and discussed in detail below with respect to FIGS. 3A-3C. The product contained in the package is typically a liquid product, but also may be a solid product or a combination of a liquid and solid product.

The polymeric flip-top closure is designed to be applied into the finish of the container, and is configured to be extremely difficult to remove thereform. The polymeric flip-top closure is configured to remain with the container, which reduces environmental waste when the package is recycled. It is also desirable for the container to be made of the same material as the flip-top closure to assist in post-consumer recycling. The polymeric flip-top closure is desirably lightweight and the container to be used with the polymeric closure is also desirably lightweight. By being lightweight, the design of the polymeric flip-top closure aids in significantly reducing material usage in the package.

Referring back to FIGS. 1A-1D, the polymeric flip-top closure 10 includes a first closure portion or lid 12 and a second closure portion or base 14. The first closure portion 12 is adapted to be flipped with respect to the second closure portion 14 via a hinge 70, as will be discussed in detail below.

The first closure portion 12 includes a polymeric top wall portion 18. The polymeric top wall portion 18 includes an exterior surface 18*a* and an interior surface 18*b*. The polymeric top wall portion includes at least one tamper-evident winged section and a middle section.

Figure 1E:
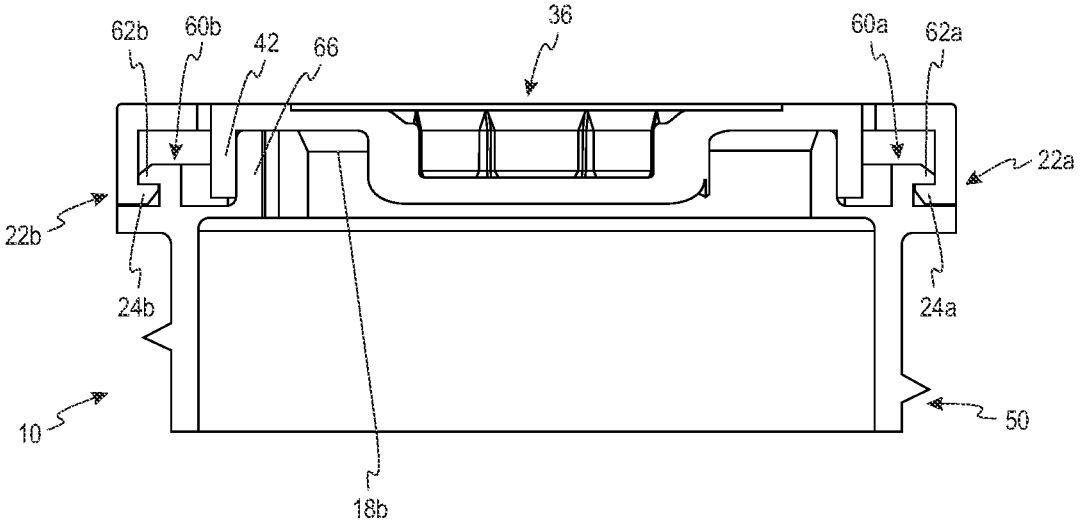
FIG. 1E is a general cross-sectional view (without cross-hatching) of line 1E-1E shown in FIG. 1A.

In this embodiment, the first closure portion 12 includes first and second tamper-evident winged sections 22*a*, 22*b*. The first and second tamper-evident winged sections 22*a*, 22*b* are located on opposing ends of the first closure portion 12 as shown in FIG. 1A. The first and second tamper-evident winged sections 22*a*, 22*b* and the middle section 28 therebetween are detachably connected via respective frangible connections 34*a*, 34*b*. Each of the first and second tamper-evident winged sections 22*a*, 22*b* forms a respective undercut 24*a*, 24*b*. This is best shown in FIGS. 1C, 1E. The undercuts 24*a*, 24*b*, as will be discussed below, assist in providing tamper-evident to the polymeric flip-top closure 10. It is contemplated that the first closure portion may include exactly one tamper-evident winged section instead of the plurality of tamper-evident winged sections 22*a*, 22*b* shown in FIGS. 1A-IE.

The first closure portion 12 further including a drivable structure 36 to assist in threading the polymeric flip-top closure 10 into a container (e.g., container 108). The drivable structure 36 is located on the exterior surface 18*a* of the polymeric top wall portion 18. The drivable structure 38 is typically a recessed structure. One non-limiting example of a recessed drivable structure 36 is shown in FIGS. 1A, 1C as a recessed flower-like structure 38. The recessed flower-like structure 38 is located in a general center of the first closure portion 12. This location assists in more evenly distributing the force in threading the flip-top closure into the container. The recessed drivable structure in one embodiment protrudes outwardly from a remainder of the interior surface of the first closure portion.

It is contemplated, however, that the location of the drivable structure may differ from that shown in FIG. 1A. It is noted that a driver for threading the polymeric flip-top closure into a container would need to have a corresponding structure to engage into and rotate the recessed structure of the drivable structure.

It is contemplated, however, that other recessed structures may be formed on an interior surface of the polymeric flip-top closure to assist in threading the closure into the container. These other recessed structures may be polygonal or non-polygonal shapes. One non-limiting example of another recessed structure is shown in FIGS. 5A-5D, which will be discussed below. It may be desirable to have a recessed shape that is not a standard shape (e.g., not hexagonal) so that a user would not have a standardized tool tin an attempt to unthread the polymeric closure from the container.

To prevent or inhibit tampering, the recessed structure (e.g., the recessed flower-like structure 38) may be covered by a non-removable sticker, tape or label. A non-removable label, tape or sticker 180 is shown in package 100' of FIG. 3D covering the hidden recessed flower-like structure 38. FIG. 3D shows a package 100' that is identical to the package 100 of FIG. 3A except that the removable label, tape or sticker 180 has been added to the polymeric flip-top closure 10 that covers the recessed flower-like structure 38. The non-removable label, tape or sticker 180 prevents or inhibits a user from attempting to unthread the polymeric flip-top closure 10 from the container 108 and gain access to the contents in the container 108.

It is contemplated that other tamper-evident features may be used to prevent or inhibit access to the recessed structure. These other potential tamper-evident features must be removed and/or broken, which leaves evidence of potential tampering or access into the container. One non-limiting example of such a tamper-evident feature would be a polymeric plug that resides in the recessed structure. Another non-limiting example would be a shrink wrap that covers the recessed structure.

It is contemplated that a protruding structure may be used on the exterior surface of the first closure portion instead of a recessed structure. Depending on the tamper-evident feature, a protruding structure, however, will likely to be more tamper-prone.

As shown best in FIG. 1C, the recessed flower-like structure 38 extends into the interior surface 18*b* of the polymeric top wall portion 18. The recessed flower-like structure 38 protrudes downwardly from a general remainder of the interior surface 18*b* of the polymeric top wall portion 18. The interior surface also forms at least one opposing end extension extending from the recessed structure.

In the embodiment of FIG. 1C, the recessed flower-like structure 38 includes a pair of opposing end extensions 40*a*, 40*b* extending therefrom. The plurality of opposing end extensions 40*a*, 40*b*, as will be discussed below, assists in transmitting and directing force for threading the polymeric flip-top closure 10 into the container 108. Each of the pair of opposing end extensions 40*a*, 40*b* is of a generally triangular shape. It is contemplated that the pair of opposing end extensions may be other shapes and sizes including both polygonal and non-polygonal shapes.

The interior surface 18*b* of the polymeric top wall portion 18 further includes a first sealing ring 42, which in conjunction with a second sealing ring 66 of the second closure portion 14, forms a seal in the polymeric flip-top closure 10. This sealing mechanism is referred to as an inner seal. Such an inner seal potentially assists in further preventing or inhibiting air, moisture or other potential contaminants from contacting the contents in the container. The first sealing ring 42 of FIGS. 1C, 1D is shown as being a generally circular shape. It is contemplated that other shapes may be used in forming a first sealing ring including a generally oval shape.

It is contemplated that other sealing mechanisms may be used, if desirable, to prevent or inhibit air, moisture or other potential contaminants from contacting the contents in the container.

It is contemplated that the first closure portion may have a lifting aid to assist a user in opening the first closure portion with respect to the second closure portion. The lifting aid may be a lifting extension or a lifting indentation that assists a user in opening the first closure portion with respect to the second closure portion. If a lifting aid were used, it would be shaped and sized for a user to grasp or contact when opening the polymeric flip-top closure. The lifting aid would be located generally opposite of the hinge.

Referring to FIGS. 1A-1C, The second closure portion 14 includes a polymeric annular skirt portion 50 and a ledge 52 encompassing and extending outwardly from the polymeric annular skirt portion 50. The polymeric annular skirt portion 50 includes an exterior surface 50*a* and an interior surface 50*b*. The exterior surface 50*a* of the polymeric annular skirt portion 50 forms an external thread formation 56.

The external thread formation 56 is for mating engagement with an internal thread formation of a container. The external thread formation 56 is shown in FIGS. 1A-1C as being continuous threading. The external thread formation 56 in this embodiment is a helical formation. It is contemplated that the external thread formation may be discontinuous. One non-limiting example is an external thread formation including a first closure lead and a second closure lead. It is also contemplated that the external thread formation of the closure may differ from a helical thread formation. It is also contemplated that other external thread formations may be used in the closure to mate with a corresponding internal thread formation of the container.

The interior surface 50*b* of the polymeric annular skirt portion 50 also includes a mechanical closure stop 58 shown in FIGS. 1A, 1C. As will be discussed below, the mechanical closure stop 58 works in conjunction with a mechanical container stop to prevent or inhibit the polymeric flip-top closure from being overthreaded (i.e., over torqued) into the container 108. The mechanical closure stop 58 is located father from the polymeric top wall portion 18 than the external thread formation 56.

The ledge of the second closure portion includes at least one locking protrusion. In this embodiment, the ledge 52 includes a plurality of locking protrusions 60*a*, 60*b*. Each of the locking protrusions 60*a*, 60*b* includes a respective undercut 62, 62*b*. The locking protrusions 60*a*, 60*b* correspond with the first and second tamper-evident winged sections 22*a*, 22*b*, respectively, to from a tamper-evident structure indicating that the container may have been accessed. Specifically, the undercuts 62*a*, 62*b* of lockingly engage respective undercuts 24*a*, 24*b*. This is best shown in FIGS. 1C, 1E.

The second closure portion 14 includes the second sealing ring 66. The second sealing ring 66, in conjunction with the first sealing ring 42, forms an inner seal as discussed above. One of first and the second sealing rings 42, 66 is slightly larger than the other to assist in forming an abutting relationship when the polymeric flip-top closure is in a closed position. The second sealing ring 66 is shown as being a generally circular shape. It is contemplated that other shapes may be used in forming the second sealing ring including a generally oval shape.

The second closure portion 14 in this embodiment includes a pair of opposing end extensions 64*a*, 64*b*. The pair of opposing end extensions 64*a*, 64*b* extends from the second sealing ring 66 and is in a generally triangular shape. It is contemplated that the pair of opposing end extensions may be other shapes and sizes including both polygonal and non-polygonal shapes.

The pair of opposing end extensions 64*a*, 64*b* engages the pair of opposing end extensions 40*a*, 40*b*, respectively, when threading the polymeric flip-top closure 10 into the container 108. The pair of opposing end extensions 64*a*, 64*b*, in conjunction with the pair of opposing end extensions 40*a*, 40*b*, assists in transmitting and directing force from the drivable structure 36 to thread the closure 10 into the container 108.

The interior surfaces of the ledge 52 and the polymeric annular skirt portion 50 form an opening 68 through the second closure portion 14. The opening 68 allows a user to gain access to the contents of the container 108. The shape of the opening 68 is shown as being generally circular in shape in FIG. 1B. This shape, for example, assists a user in allowing the contents to be smoothly and controllable poured or accessed from the container. It is contemplated that the shape of the opening may vary from that depicted in, for example, FIG. 1B. Some non-limiting examples of shapes that may form an opening include generally oval or tear-dropped.

As shown in FIG. 1B, the height H1 of the first closure portion 12 is generally from about 0.08 to about 0.20 inch and, more specifically, from about 0.1 to about 0.15 inch. The height H2 of the second closure portion 14 is generally from about 0.25 to about 0.75 inch and, more specifically, from about 0.35 to about 0.65 inch. The height H1 of the first closure portion 12 is less than the height H2 of the second closure portion 14 in this embodiment. The height H3 of the polymeric flip-top closure 10 is generally from about 0.3 to about 1 inch and, more specifically, from about 0.5 to about 0.75 inch in this embodiment.

As shown in FIGS. 1A, 1C, 1D, the hinge 70 connects the first closure portion 12 and the second closure portion 14. The hinge 70 is shown in its folded position in FIG. 1A and its in unfolded position in FIGS. 1C, 1D. The hinge 70 is flexible in that it can be moved from an unfolded position to a folded position. The hinge 70 is continuous and is one integral component in this embodiment. One non-limiting example of a hinge that may be used is a butterfly hinge. It is contemplated that other hinge types may be used. The selected hinges to connect the first and second closure portions may have thinner and thicker sections. It is contemplated that a hinge may be used in the polymeric flip-top closure is a plurality of hinges. It is also contemplated that the hinge may be tethered.

The plurality of frangible connections 34*a*, 34*b* may be formed by molded-in-bridges in one embodiment. In this embodiment, the molded-in-bridges are formed using a feature in the mold. The plurality of frangible connections is in the form of scoring or scored lines, notches, leaders, nicks or other lines of weaknesses.

The flip-top closures of the present invention may include an oxygen-scavenger material. This oxygen-scavenger material may be distributed within the closure or may be a separate layer. The oxygen-scavenger material may be any material that assists in removing oxygen within the container, while having little or no effect on the contents within the container.

Alternatively, or in addition to, the flip-top closures may include an oxygen-barrier material. The oxygen-barrier material may be added as a separate layer or may be integrated within the flip-top closure itself. The oxygen-barrier materials assist in preventing or inhibiting oxygen from entering the container through the flip-top closure. These materials may include, but are not limited to, ethylene vinyl alcohol (EVOH). It is contemplated that other oxygen-barrier materials may be used in the flip-top closure.

The polymeric flip-top closure 10 is typically made of a polyolefin (e.g., polyethylene (PE), polypropylene (PP)) or blends thereof. One example of a polyethylene that may be used is high density polyethylene (HDPE), low density polyethylene (LDPE), or the combination thereof. It is contemplated that the flip-top closure may be made of other polymeric materials.

The polymeric flip-top closure is typically light weight. The polymeric flip-top closure is generally from about 2.5 to about 15 grams and typically is from about 3.5 to about 8 grams. In other embodiments, the polymeric flip-top closure is from about 5 to about 15 grams, or from about 7 to about 10 grams. The polymeric flip-top closure in a further embodiment is from about 4 to about 12 grams, or from about 6 to about 9 grams.

The polymeric flip-top closures are typically formed by processes such as injection or compression molding.

Figure 2:
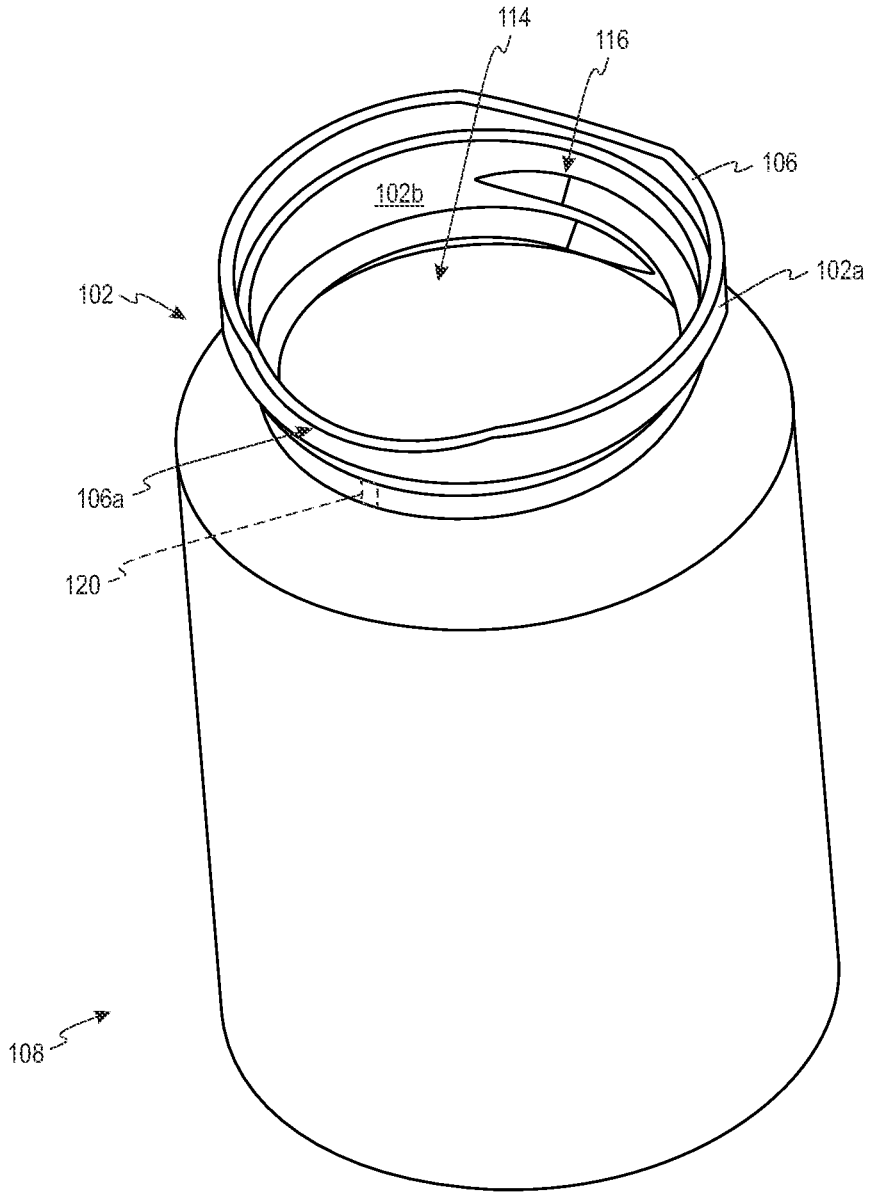
FIG. 2 is a top perspective view of a container according to one embodiment.

A neck portion or finish 102 of the container 108 is shown in FIG. 2. The container 108 is used with the polymeric flip-top closure 10 in one embodiment. The container 108 includes the neck portion 102 that defines an opening 114. The neck portion 102 has an exterior surface 102*a* and an interior surface 102*b*. The neck portion 102 of the container 108 includes a rim 106 with a contoured rim section 106*a* that allows accessibility for a user to grasp the polymeric flip-top closure 10 and move the flip-top closure from a closed position to an open position. The contoured rim section 106*a* is in a shape of a concave structure. It is contemplated that other shapes or configurations of the contoured rim section may be used that can allow a user to flip the first closure portion with respect to the second closure portion.

The interior surface 102*b* of the neck portion 102 includes an internal thread formation 116. The internal thread formation 116 is for mating engagement with the external thread formation 56 of the polymeric flip-top closure 10. The internal thread formation 116 is shown in FIG. 2 as being continuous threading. The internal thread formation 116 in this embodiment is a helical formation. It is contemplated that the internal thread formation may be discontinuous. One non-limiting example is an internal thread formation including a first container lead and a second container lead. It is also contemplated that the internal thread formation of the container may differ from a helical thread formation. It is also contemplated that other internal thread formation may be used in the container to mate with a corresponding external thread formation of the closure.

The interior surface 102*b* of the neck portion also includes a mechanical container stop 120. The mechanical container stop 120 works in conjunction with the mechanical closure stop 58 to prevent or inhibit the polymeric flip-top closure 10 from being overthreaded (i.e. over torqued) into the container 108. More specifically, the mechanical container stop 120 is in an abutting relationship with the mechanical closure stop 58, resulting in no further rotation or threading of the polymeric flip-top closure 10 into the container 108.

The container 108 is typically made of polymeric material. The container 108 may be made of a polyolefin (e.g., polyethylene (PE), polypropylene (PP)) or blends thereof. One example of a polyethylene that may be used is high density polyethylene (HDPE), low density polyethylene (LDPE), or the combination thereof. It is contemplated that the container may be formed of other polymeric or copolymer materials. As mentioned above, it is desirable for the container 108 and the polymeric flip-top closure 10 be made of the same material to assist in post-consumer recycling.

Figure 3A:
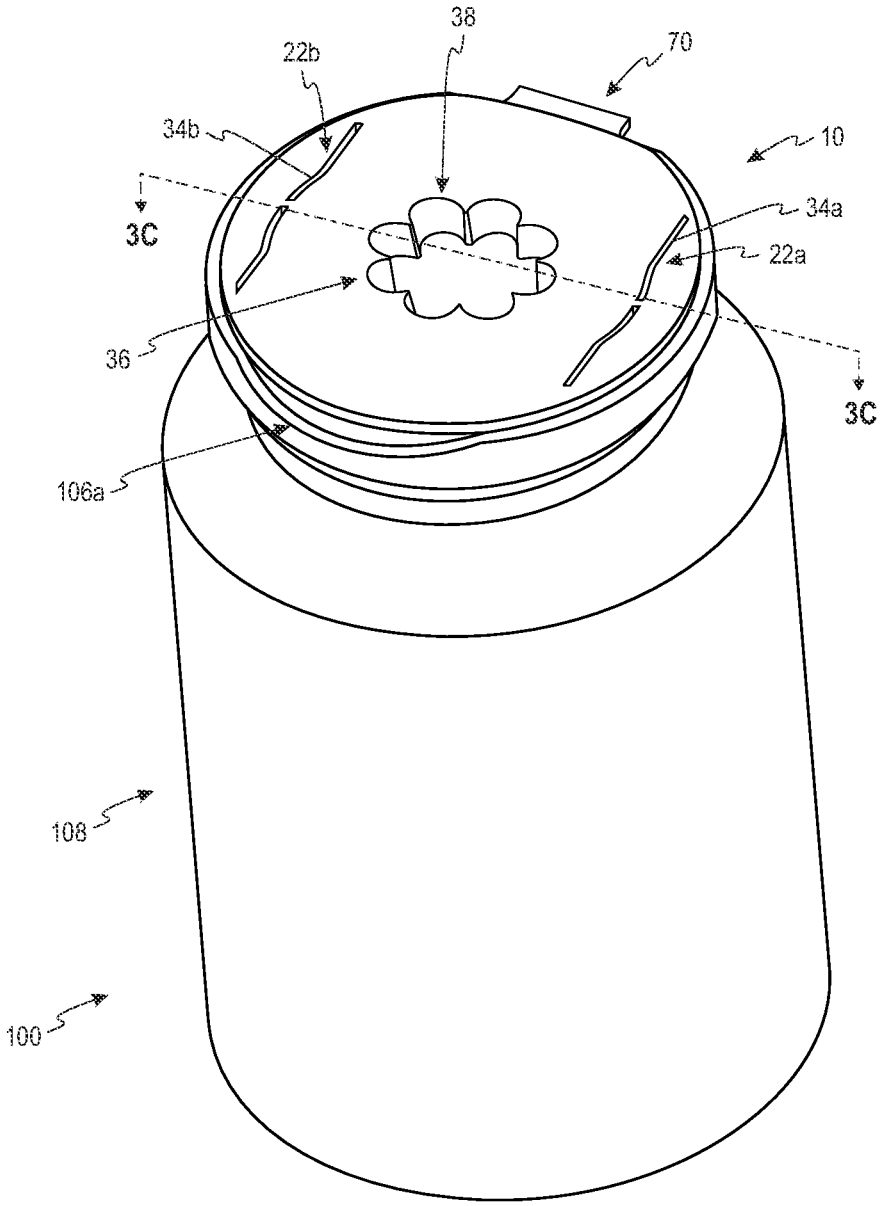
FIG. 3A is a top perspective view of a package including the flip-top closure of FIG. 1A and the container of FIG. 2 in an initially closed position according to one embodiment.
Figure 3B:
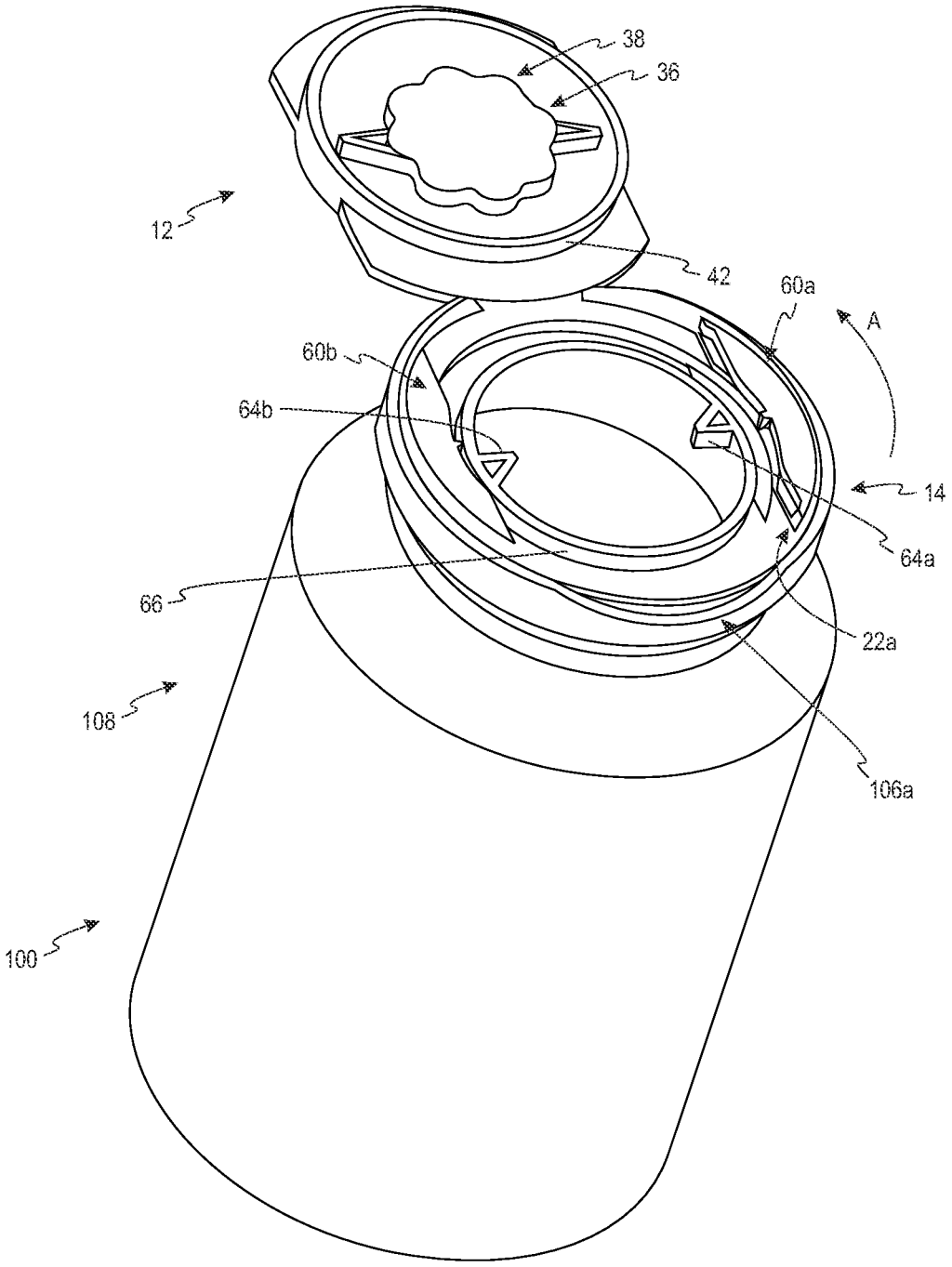
FIG. 3B is a top perspective view of the package of FIG. 3A in an open position after being moved from a closed position.
Figure 3C:
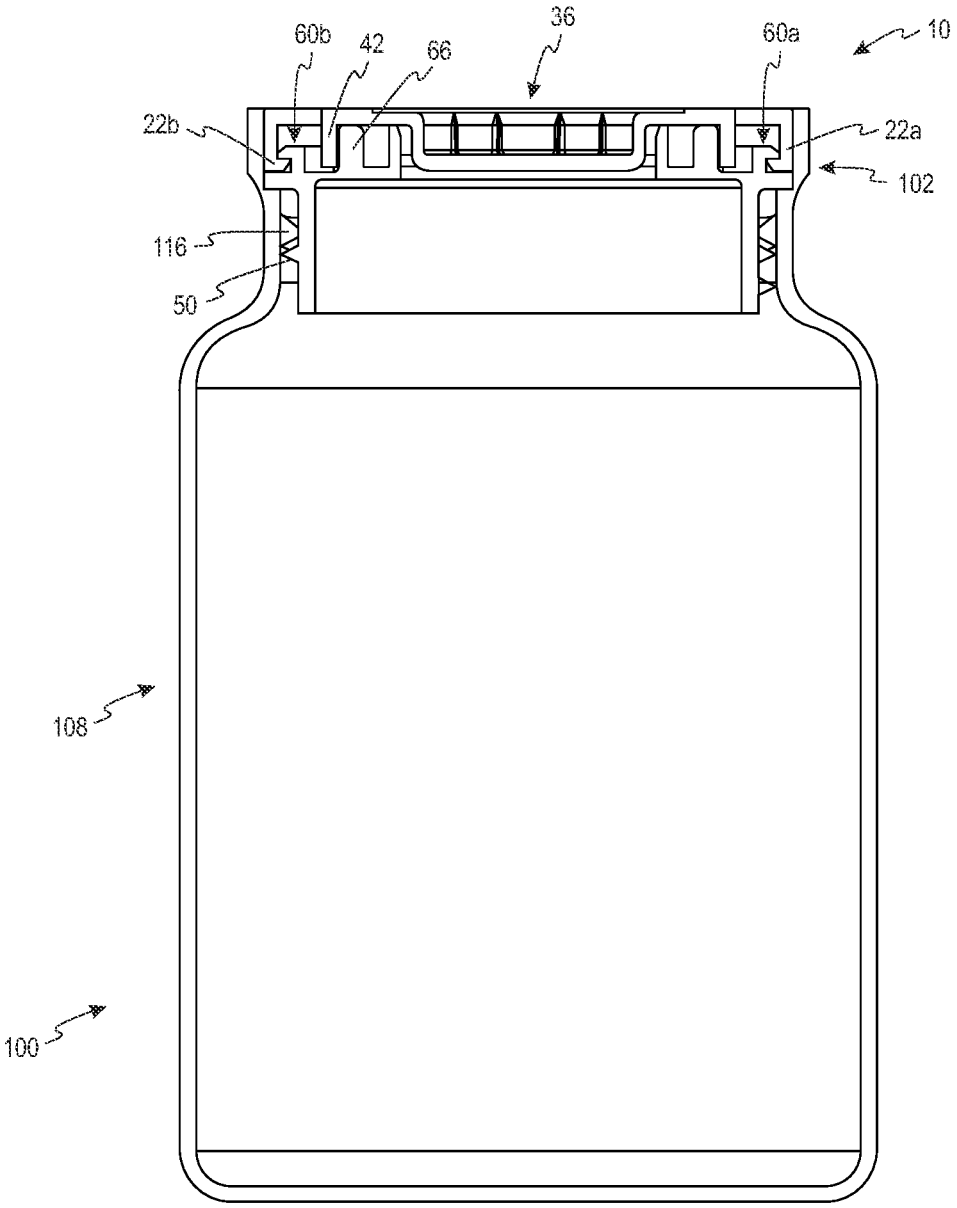
FIG. 3C is a general cross-sectional view (without cross-hatching) of line 3D-3D shown in FIG. 3A.
Figure 3D:
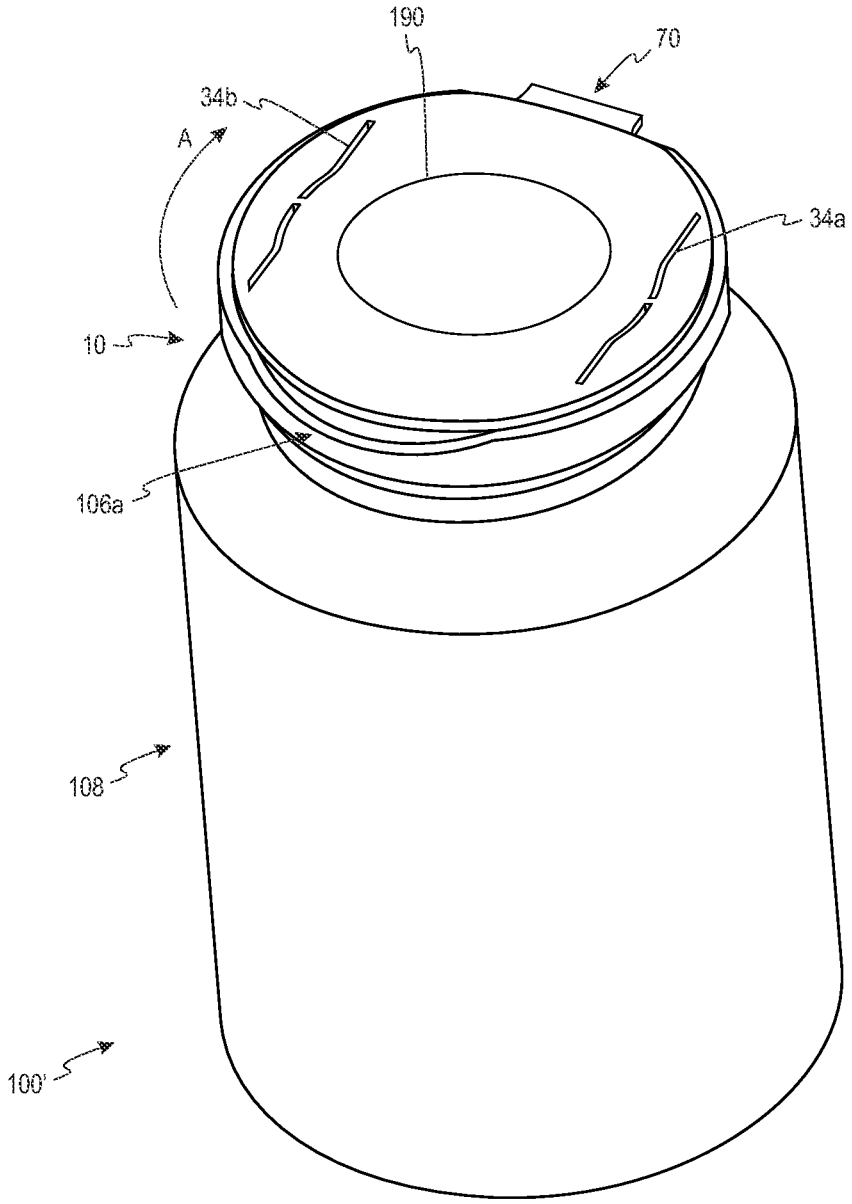
FIG. 3D is a top perspective view of a package including the flip-top closure of FIG. 1A and the container of FIG. 2 in an initially closed position according to another embodiment.
Figure 4:
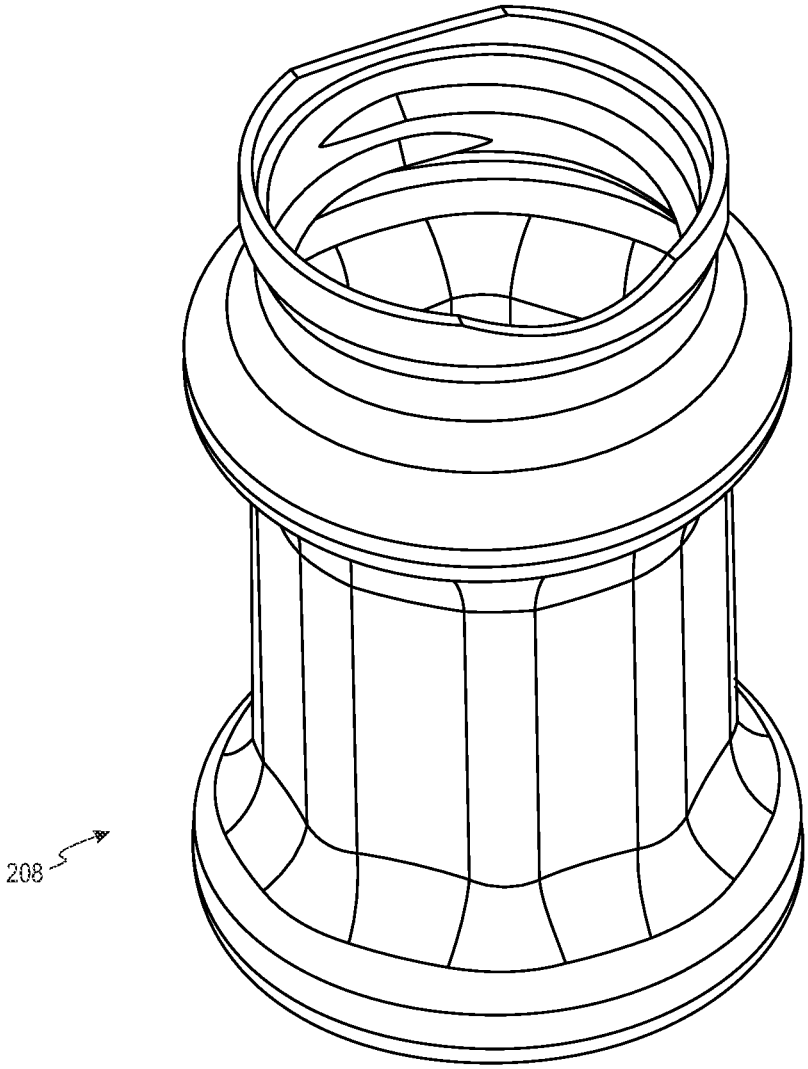
FIG. 4 is a top perspective view of a container according to another embodiment.
Figure 5A:
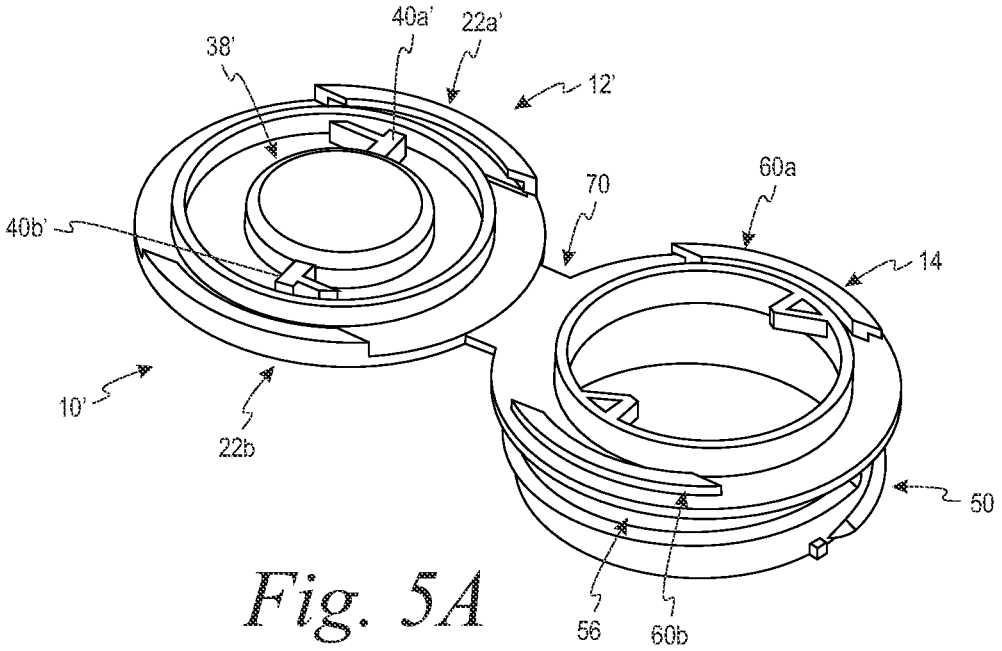
FIG. 5A is a top perspective view of a flip-top closure in an initially open position according to a further embodiment.
Figure 5B:
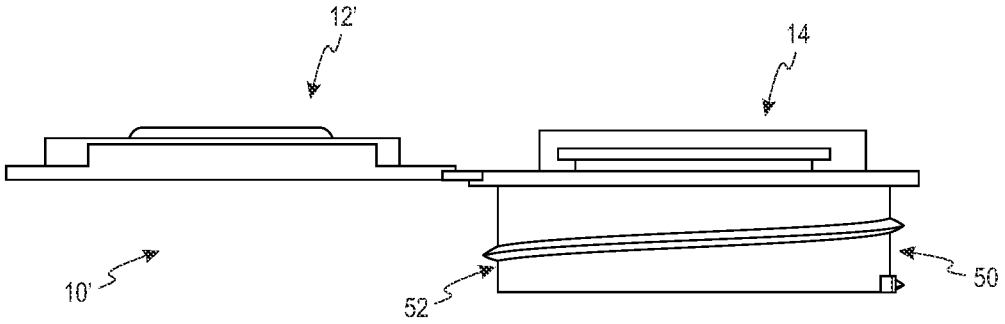
FIG. 5B is a side view of the flip-top closure of FIG. 5A in the initially open position.
Figure 5C:
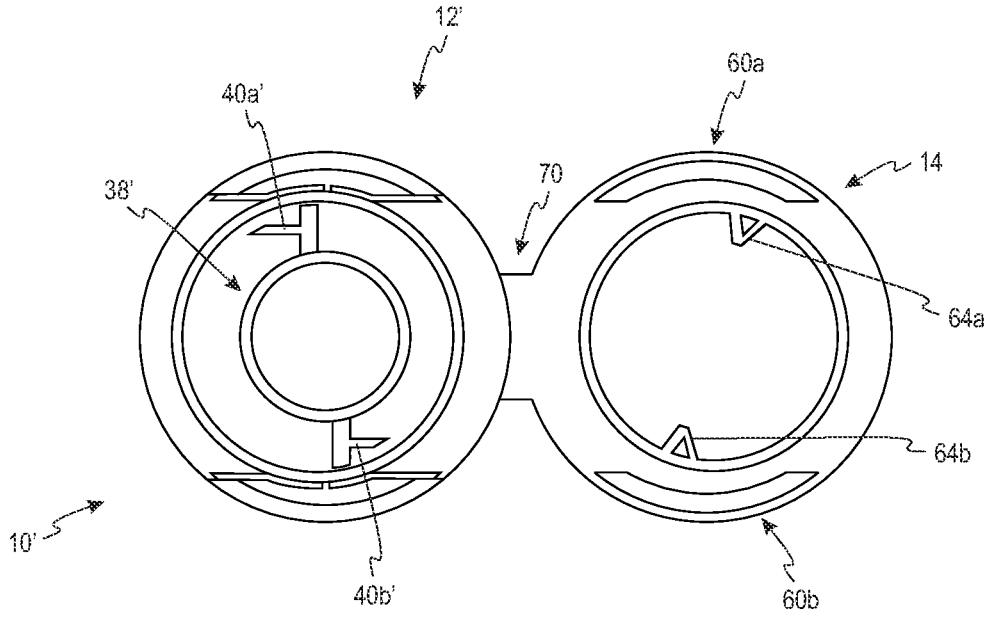
FIG. 5C is a top view of the flip-top closure of FIG. 5A in the initially open position.

FIG. 3A shows the polymeric flip-top closure 10 and the container 108 of the package 100 in a closed position. To open the container 108 and gain access to the product therein, the second closure portion 14 is initially flipped with respect to the first closure portion 12. A user grasps the first closure portion 12 and moves the same in the general direction of arrow A as shown in FIGS. 3A, 3B. This movement is in an upwardly and outwardly direction from the contoured rim section 106*a*. During this movement along arrow A from its initially closed position (FIG. 3A) to an open position (FIG. 3B), the plurality of frangible connections 34*a*, 34*b* is broken. The plurality of frangible connections 34*a*, 34*b* must be broken before the polymeric flip-top portion 10 can be moved to an open position from its initially closed position.

After the plurality of frangible connections 34*a*, 34*b* is broken, the plurality of first and second tamper-evident winged sections 22*a*, 22*b* remain lockingly engaged with respective locking protrusions 60*a*, 60*b* of the second closure portion 14. This position of the package 100 is best shown in the cross-sectional view of FIG. 3C. The plurality of first and second tamper-evident winged sections 22*a*, 22*b* is separated from the remainder of the first closure portion 12, which provides tamper-evidency to a user. Once in the open, flipped position, a user may gain access to the contents of the container.

The rotation of the first closure portion to the second closure portion in one embodiment is from about 150 to 270 degrees. In another embodiment, the rotation of the first closure portion to the second closure portion in one embodiment is from about 150 to 225 degrees. In a further embodiment, the rotation of the first closure portion to the second closure portion in one embodiment is from about 150 to 180 degrees.

Referring to FIGS. 5A-5D, a closure 10' is shown in another embodiment. The polymeric flip-top closure 10' includes a first closure portion 12' and the second closure portion 14. The first closure portion 12' and the second closure portion 14 are connected via the hinge 70.

The polymeric flip-top closure 10' is the same as the polymeric flip-top closure 10 described above except for the drivable structure. The polymeric flip-top closure 10' includes a drivable structure 36' that includes a recessed circular structure 38' with a pair of opposing end extensions 40*a*', 40*b*'. The pair of opposing end extensions 40*a*', 40*b*' functions in abutting the end extensions 64*a*, 64*b*, respectively, in a similar manner as the end extensions 40*a*, 40*b*. Each of the pair of opposing end extensions 40*a*', 40*b*' is in an inverted T-shape. It is contemplated that other shapes may be used as end extensions.

In another embodiment, a polymeric flip-top closure may be manufactured in the absence of external threading. The polymeric flip-top closure would be a snap-on, flip-top closure that would be inserted into a container. The removal would be very difficult and would invariably leave damage marks on the closure indicating to a user that the closure has been tampered with.

Other than the external thread formation of the snap-on, flip-top closure, the first and second closure portions of the snap-on, flip-top closure may be configured using the exact same or similar features disclosed in the first and second closure portions 12, 14 of the polymeric flip-top closure 10. It is noted that there would need to be a plunging force applied to the snap-on, flip-top closure to overcome the interference of a snap feature over the retention ring feature.

Figure 6A:
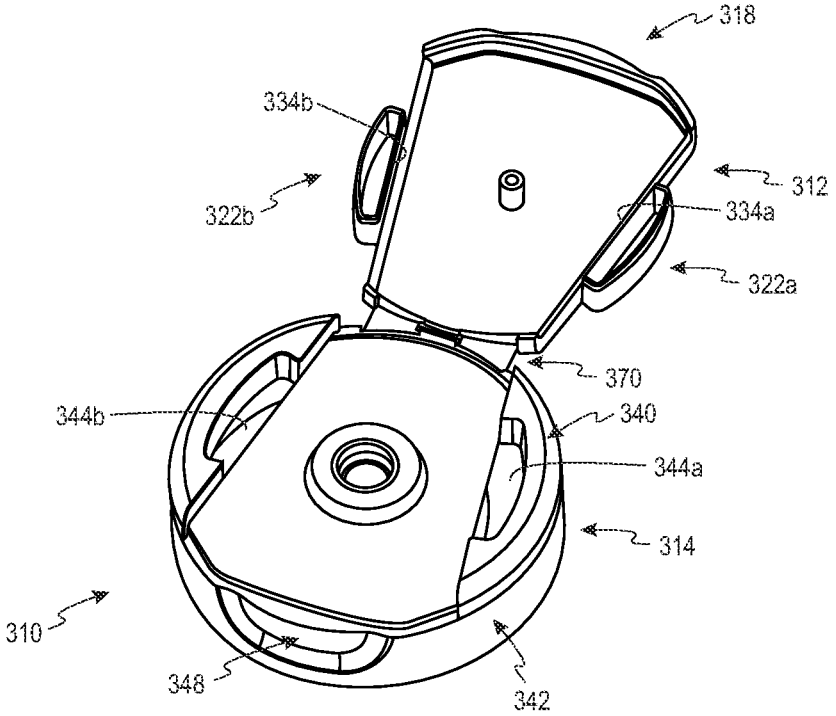
FIG. 6A is a top perspective view of a flip-top closure in an initially open position according to yet another embodiment.
Figure 6B:
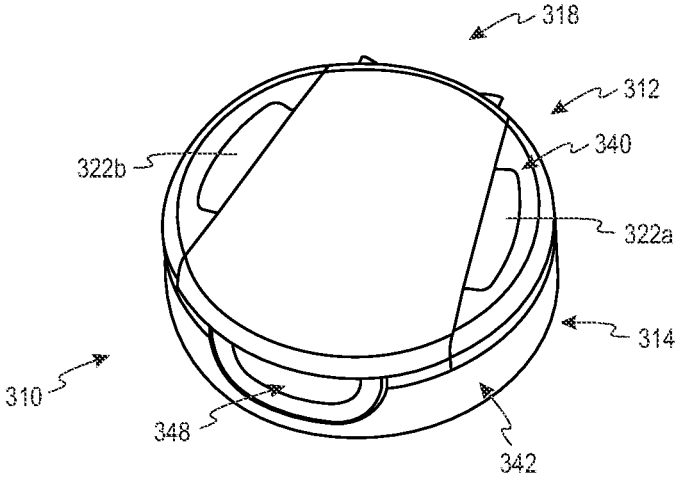
FIG. 6B is a top perspective view of the flip-top closure in a closed position of FIG. 6A.
Figure 6C:
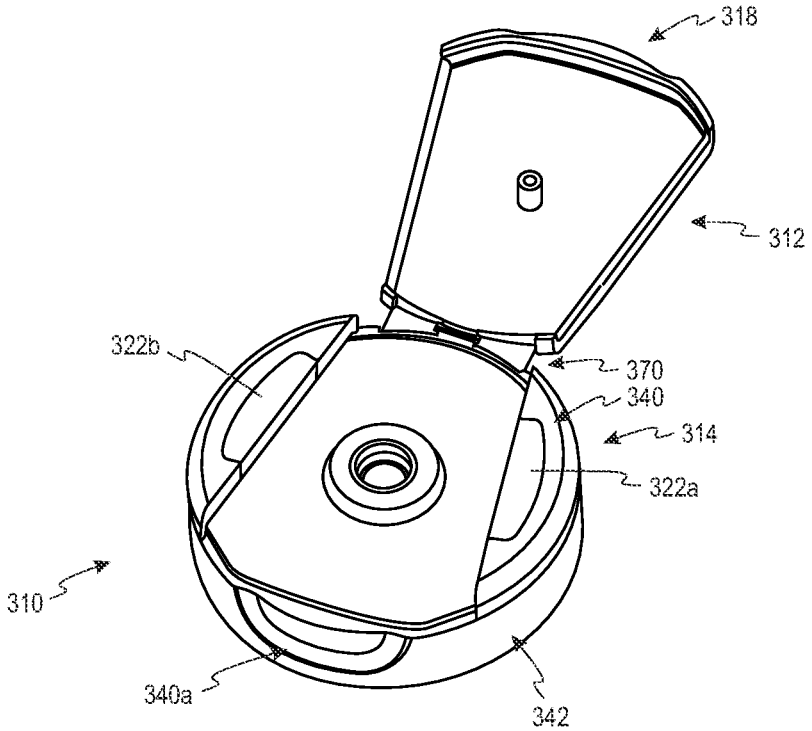
FIG. 6C is a top perspective view of the flip-top closure of FIG. 6A in an open position after being moved from a closed position.

A non-limiting example of a polymeric snap-on, flip-top closure is shown in FIGS. 6A-6C. FIGS. 6A-6C include a polymeric snap-on, flip-top closure 310. The polymeric snap-on, flip-top closure 310 includes a first closure portion 312 and a second closure portion 314. The first and second closure portions 312, 314 are connected via a hinge 370.

The polymeric top wall portion includes at least one tamper-evident wing in one embodiment. In this embodiment, the at least one tamper-evident wing includes an undercut. The at least one tamper-evident wing is detachably connected to a remainder of the polymeric top wall portion via a frangible connection.

In the embodiment of FIGS. 6A-6C, the first closure portion 312 includes a polymeric top wall portion 318. The first closure portion 312 includes first and second tamper-evident wings or ears 322*a*, 322*b* that extend outwardly from a remainder of the polymeric top wall portion 318. The first and second tamper-evident wings or ears 322*a*, 322*b* includes respective undercuts. The first and second tamper-evident wings or ears 322*a*, 322*b* are detachably connected to a remainder of the polymeric top wall portion 318 via respective frangible connections 334*a*, 334*b*.

The second closure portion 314 includes a polymeric top wall portion 340 and a polymeric annular skirt portion 342 encompassing and extending from the polymeric top wall portion 340. The polymeric top wall portion forms at least one locking recess that includes an undercut in one embodiment. The at least one locking recess is sized and configured to receive the at least one tamper-evident wing or ear. In this embodiment, the polymeric top wall portion 340 forms a plurality of locking recesses 344*a*, 344*b*. Each of the plurality of locking recesses 344*a*, 344*b* includes a respective undercut. The second closure portion 314 includes a contoured area 348 that enables a user to more easily grasp the first closure portion 312 for movement from a closed position to an open position.

In the initially closed position of the snap-on, flip-top closure, the undercut of the at least one tamper-evident wing corresponds with and lockingly engages with the at least one locking recess. During movement of the hinge from the initially closed position to an open position, the at least one frangible connection breaks leaving the at least one tamper-evident wing being lockingly engaged with the at least one locking recess.

FIG. 6A is a top perspective view of the snap-on, flip-top closure 310 in an initially open position. The snap-on, flip-top closure 310 is moved from the initially open position in FIG. 6A to the closed position of FIG. 6B. The first and second tamper-evident wings 322*a*, 322*b* lockingly engage respective features in the second closure portion 314. FIG. 6C shows the snap-on, flip-top closure 310 of FIG. 6A in an open position after being moved from a closed position. Since the first and second tamper-evident wings 322*a*, 322*b* are lockingly engaged, they remain with the second closure portion 314.

The polymeric flip-top closures of the present invention are desirable in both low-temperature and high-temperature applications. The polymeric flip-top closures may be used in low-temperature applications such as an ambient or a cold fill. These applications include aseptic applications such as dairy products, water, sports drinks, and pressurized products such as carbonated soft drinks. It is contemplated that other low-temperature applications may be used with the polymeric closures formed by the processes of the present invention.

The polymeric flip-top closures of the present invention may be exposed to high-temperature applications such as hot-fill, pasteurization, and retort applications. A hot fill application is generally performed at temperatures around 185° F., while a hot fill with pasteurization is generally performed at temperatures around 205° F. Retort applications are typically done at temperatures greater than 250° F. It is contemplated that the polymeric flip-top closures of the present invention can be used in other high-temperature applications.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention.

What is claimed is:

1. A tamper-evident, flip-top closure, the closure comprising: a first closure portion including a polymeric top wall portion, the polymeric top wall portion including an exterior surface and an interior surface, the polymeric top wall portion including at least one tamper-evident winged section and a middle section, the at least one tamper-evident winged section and the middle section being detachably connected via a frangible connection, the at least one tamper-evident winged section forming an undercut, the exterior surface of the polymeric top wall portion including a drivable structure to assist in threading the flip-top closure into a container; a second closure portion including a polymeric annular skirt portion and a ledge, the ledge encompassing and extending outwardly from the polymeric annular skirt portion, the polymeric annular skirt portion including an exterior surface and an interior surface, the exterior surface of the polymeric annular skirt portion forming an external thread formation, the ledge including at least one locking protrusion, the interior surface of the polymeric annular skirt portion forming an opening therethrough; and a hinge connecting the first closure portion and the second closure portion, wherein in an initially closed position of the flip-top closure, the undercut of the at least one tamper-evident winged section corresponds with and lockingly engages with the at least one locking protrusion, wherein during movement of the hinge from the initially closed position to an open position, the frangible connection breaks leaving the at least one tamper-evident winged section being lockingly engaged with the at least one locking protrusion, the drivable structure is a recessed structure, the drivable structure protrudes outwardly from a remainder of the interior surface of the polymeric top wall portion, the interior surface of the polymeric top wall portion includes at least one end extension extending therefrom and wherein the second closure portion includes at least one end extension, the end extension of the polymeric top wall portion and the end extension of the second closure portion being configured and located to abut each other and assist in threading of the flip-top closure into the container.

2. The closure of claim 1, wherein the at least one end extension of the polymeric top wall portion is a plurality of end extensions and wherein the at least one end extension of the second closure portion is a plurality of end extensions, the plurality of end extensions of the polymeric top wall portion and the plurality of end extensions of the second closure portion being configured and located to abut a respective one of each other and assist in threading of the flip-top closure into the container.

3. The closure of claim 1, wherein the first closure portion further includes a first sealing ring and the second closure portion further includes a second sealing ring, wherein one of the first and the second sealing rings is slightly larger than the other and forms a seal when the flip-top closure is in a closed position.

4. The closure of claim 1, wherein the second closure portion further includes a mechanical closure stop that corresponds with a mechanical container stop of a container to prevent or inhibit further threading of the flip-top closure into the container, the mechanical closure stop being located further from the polymeric top wall portion than the external thread formation.

5. The closure of claim 1, wherein the flip-top closure is polymeric.

6. A package comprising: a container having a neck portion defining an opening, the neck portion having an exterior surface and an interior surface, the interior surface of the neck portion including an internal thread formation; and a flip-top closure being configured for fitment into the neck portion of the container for closing the opening of the container, the flip-top closure including a first closure portion, a second closure portion, and a hinge, the first closure portion including a polymeric top wall portion, the polymeric top wall portion including an exterior surface and an interior surface, the polymeric top wall portion including at least one tamper-evident winged section and a middle section, the at least one tamper-evident winged section and the middle section being detachably connected via a frangible connection, the at least one tamper-evident winged section forming an undercut, the exterior surface of the polymeric top wall portion including a drivable structure to assist in threading the flip-top closure into the container, the second closure portion including a polymeric annular skirt portion and a ledge, the ledge encompassing and extending outwardly from the polymeric annular skirt portion, the polymeric annular skirt portion including an exterior surface and an interior surface, the exterior surface of the polymeric annular skirt portion forming an external thread formation, the external thread formation of the second closure portion being threadingly engaged with the internal thread formation of the container, the ledge including at least one locking protrusion, the interior surface of the polymeric annular skirt portion forming an opening therethrough, the hinge connecting the first closure portion and the second closure portion, wherein in an initially closed position of the flip-top closure, the undercut of the at least one tamper-evident winged section corresponds with and lockingly engages with the at least one locking protrusion, wherein during movement of the hinge from the initially closed position to an open position, the frangible connection breaks leaving the at least one tamper-evident winged section being lockingly engaged with the at least one locking protrusion, the drivable structure is a recessed structure, the drivable structure protrudes outwardly from a remainder of the interior surface of the polymeric top wall portion, the interior surface of the polymeric top wall portion includes at least one end extension extending therefrom and wherein the second closure portion includes at least one end extension, the end extension of the polymeric top wall portion and the end extension of the second closure portion being configured and located to abut each other and assist in threading of the flip-top closure into the container.

7. The package of claim 6, wherein the at least one end extension of the polymeric top wall portion is a plurality of end extensions and wherein the at least one end extension of the second closure portion is a plurality of end extensions, the plurality of end extensions of the polymeric top wall portion and the plurality of end extensions of the second closure portion being configured and located to abut a respective one of each other and assist in threading of the flip-top closure into the container.

8. The package of claim 6, wherein the first closure portion further includes a first sealing ring and the second closure portion further includes a second sealing ring, wherein one of the first and the second sealing rings is slightly larger than the other and forms a seal when the flip-top closure is in a closed position.

9. The package of claim 6, wherein the second closure portion further includes a mechanical closure stop, the container further including a mechanical container stop, the mechanical closure stop corresponding with the mechanical container stop to assist in preventing or inhibiting further threading of the flip-top closure into the container, the mechanical closure stop being located father from the polymeric top wall portion than the external thread formation.

10. A tamper-evident, flip-top closure, the closure comprising: a first closure portion including a polymeric top wall portion, the polymeric top wall portion including an exterior surface and an interior surface, the polymeric top wall portion including a plurality of opposing tamper-evident winged sections and a middle section therebetween, the plurality of opposing tamper-evident winged sections and the middle section being detachably connected via a respective one of a plurality of frangible connections, each of the plurality of opposing tamper-evident winged sections forming a respective undercut, the exterior surface of the polymeric top wall portion including a drivable structure to assist in threading the flip-top closure into a container; a second closure portion including a polymeric annular skirt portion and a ledge, the ledge encompassing and extending outwardly from the polymeric annular skirt portion, the polymeric annular skirt portion including an exterior surface and an interior surface, the exterior surface of the polymeric annular skirt portion forming an external thread formation, the ledge including a plurality of opposing locking protrusions, the interior surface of the polymeric annular skirt portion forming an opening therethrough; and a hinge connecting the first closure portion and the second closure portion, wherein in an initially closed position of the flip-top closure, each of the undercuts of the plurality of opposing tamper-evident winged sections corresponds with and lockingly engages with a respective one of the plurality of opposing locking structures, wherein during movement of the hinge from the initially closed position to an open position, the plurality of frangible connections breaks leaving the plurality of opposing tamper-evident winged sections being lockingly engaged with a respective one of the plurality of opposing locking protrusions, the drivable structure is a recessed structure, the interior surface of the first closure portion further includes a plurality of end extensions extending therefrom and wherein the second closure portion further includes a plurality of end extensions, the plurality of end extensions of the first closure portion and the plurality of end extensions of the second closure portion being configured and located to abut a respective one of each other and assist in threading of the flip-top closure into the container.

11. A package comprising: a container having a neck portion defining an opening, the neck portion having an exterior surface and an interior surface, the interior surface of the neck portion including an internal thread formation; and a flip-top closure being configured for fitment into the neck portion of the container for closing the opening of the container, the flip-top closure including a first closure portion, a second closure portion, and a hinge, the first closure portion including a polymeric top wall portion, the polymeric top wall portion including an exterior surface and an interior surface, the polymeric top wall portion including a plurality of opposing tamper-evident winged sections and a middle section therebetween, the plurality of opposing tamper-evident winged sections and the middle section being detachably connected via a respective one of a plurality of frangible connections, each of the plurality of opposing tamper-evident winged sections forming a respective undercut, the exterior surface of the polymeric top wall portion including a drivable structure to assist in threading the flip-top closure into a container, the second closure portion including a polymeric annular skirt portion and a ledge, the ledge encompassing and extending outwardly from the polymeric annular skirt portion, the polymeric annular skirt portion including an exterior surface and an interior surface, the exterior surface of the polymeric annular skirt portion forming an external thread formation, the external thread formation of the second closure portion being threadingly engaged with the internal thread formation of the container, the ledge including a plurality of opposing locking protrusions, the interior surface of the polymeric annular skirt portion forming an opening therethrough, the hinge connecting the first closure portion and the second closure portion, wherein in an initially closed position of the flip-top closure, each of the undercuts of the plurality of opposing tamper-evident winged sections corresponds with and lockingly engages with a respective one of the plurality of opposing locking structures, wherein during movement of the hinge from the initially closed position to an open position, the plurality of frangible connections breaks leaving the plurality of opposing tamper-evident winged sections being lockingly engaged with a respective one of the plurality of opposing locking protrusions, the drivable structure is a recessed structure, the interior surface of the first closure portion further includes a plurality of end extensions extending therefrom and wherein the second closure portion further includes a plurality of end extensions, the plurality of end extensions of the first closure portion and the plurality of end extensions of the second closure portion being configured and located to abut a respective one of each other and assist in threading of the flip-top closure into the container.

* * * * *